US006331517B1

(12) United States Patent
Durbut

(10) Patent No.: US 6,331,517 B1
(45) Date of Patent: Dec. 18, 2001

(54) CLEANING COMPOSITION CONTAINING A HYDROPHILIZING POLYMER

(75) Inventor: Patrick Durbut, Verviers (BE)

(73) Assignee: Colgate Palmolive Co., Piscataway, NJ (US)

( * ) Notice: Subject to any disclaimer, the term of this patent is extended or adjusted under 35 U.S.C. 154(b) by 0 days.

(21) Appl. No.: 09/920,662

(22) Filed: Aug. 2, 2001

(51) Int. Cl.[7] ..... C11D 17/00
(52) U.S. Cl. ..... 510/426; 510/475; 510/476
(58) Field of Search ..... 510/426, 475, 510/476

(56) References Cited

U.S. PATENT DOCUMENTS 5,536,440 * 7/1996 Gopalkrishnan et al. ..... 510/417
6,121,226 * 9/2000 Gosselink et al. ..... 510/400

* cited by examiner

*Primary Examiner*—Necholus Ogden
(74) *Attorney, Agent, or Firm*—Richard E. Nanfeldt

(57) ABSTRACT

The present invention relates to a cleaning composition containing an anionic surfactant, a hydrophilizing polymer and water.

1 Claim, No Drawings

CLEANING COMPOSITION CONTAINING A HYDROPHILIZING POLYMER

FIELD OF INVENTION

The present invention relates to cleaning composition for ceramic or glass surfaces, wherein the composition includes an anionic surfactant, a hydrophilizing polymer selected from the group consisting of maleic acid-olefin copolymer, or polyalkylene oxide polyacrylic acid and water.

BACKGROUND OF THE INVENTION

Numerous cleaning compositions have been disclosed in various patents. However, a major problem with these cleaning compositions is that the surface exhibits water-marks, smear or spots, when the surface is treated with the cleaning composition and subsequently dried.

U.S. Pat. No. 5,759,986 describes a cleaning composition which allegedly reduces spotting. These compositions employ a silicon polymer and a polymer which makes the treated surface hydropholic.

DE-A-2161591 teaches a cleaning composition which contains an amino containing polymer.

WO00/77143A1 describes a surface substantive polymer which makes the treated surface hydrophilic, wherein the polymer is a copolymer of N-vinylimidazole N-vinylpyrrolidone (PVPVI), a quaternized vinyl pyrrolidone/dialkylaminoalkyl acrylate or methacrylate copolymer, or a polyvinyl pyridine N-oxide polymer.

SUMMARY OF THE INVENTION

The present invention relates to a glass cleaning composition comprising an anionic surfactant, a hydrophilizing maleic acid-olefin copolymer and water, wherein the composition does not contain nonionic surfactants containing ethoxylate groups, silicon containing polymers, amino containing polymers, copolymers of N-vinylimidazole N-vinylpyrrolidone (PVPVI), or quaternized vinyl pyrrolidone/dialkylaminoalkyl acrylate or methacrylate copolymers, or polyvinyl pyridine N-oxide polymers.

It is an object of the instant invention to provide a glass cleaning composition, wherein the hydrophilizing polymer renders the treated surface hydrophilic such that the contact angle of water on the treated surface is less than 40°, more preferably less than 30° and most preferably less than 20°.

A further object of the instant invention is to provide a glass cleaning composition which renders the treated surface free of streaks, water-marks, smear and spots, after the surface has been treated with the cleaning composition and subsequently dried.

DETAILED DESCRIPTION OF THE INVENTION

The present invention relates to a ceramic or glass cleaning composition which renders the surface being treated hydrophilic, wherein the composition comprises approximately by weight:

(a) 0.01% to 10% of an anionic surfactant containing an alkyl group;

(b) 0.01% to 2% of a hydrophilizing polymer which is a maleic acid-olefin copolymer, wherein the polymer can be partially esterified by polyethylene glycol, or partially esterified by an amphiphilic moiety, or an acrylic acid polymer partially esterified by polyethylene glycol, or partially esterified by an amphiphilic moiety; and (c) the balance being water, wherein the composition does not contain an amino containing polymer, a silicon containing polymer, a nonionic surfactant containing ethoxylate groups, N-vinylimidazole N-vinylpyrrolidone (PVPVI), or quaternized vinyl pyrrolidone/dialkylaminoalkyl acrylate or methacrylate copolymers, or polyvinyl pyridine N-oxide polymers.

The anionic sulfonate surfactants which may be used in the composition of this invention are water soluble and include the sodium, potassium, ammonium and ethanolammonium salts of linear $C_8$–$C_{16}$ alkyl benzene sulfonates; $C_{10}$–$C_{20}$ paraffin sulfonates, alpha olefin sulfonates containing about 10–24 carbon atoms and $C_8$–$C_{18}$ alkyl sulfates, ethoxylated alkyl ether sulfates and mixtures thereof. The preferred anionic sulfonate surfactant is an alkyl ethoxylated alkyl ether sulfate surfactant.

The paraffin sulfonates may be monosulfonates or di-sulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos. 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or poly-sulfonates.

Examples of suitable other sulfonated anionic detergents are the well known higher alkyl mononuclear aromatic sulfonates, such as the higher alkylbenzene sulfonates containing 9 to 18 or preferably 9 to 16 carbon atoms in the higher alkyl group in a straight or branched chain, or $C_{8-15}$ alkyl toluene sulfonates. A preferred alkylbenzene sulfonate is a linear alkylbenzene sulfonate having a higher content of 3-phenyl (or higher) isomers and a correspondingly lower content (well below 50%) of 2-phenyl (or lower) isomers, such as those sulfonates wherein the benzene ring is attached mostly at the 3 or higher (for example 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

The C8-18 ethoxylated alkyl ether sulfate surfactants have the structure $$R—(OCH_2CH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12-14}$ or $C_{12-16}$ and M is an ammonium cation or a metal cation, most preferably sodium.

The ethoxylated alkyl ether sulfate may be made by sulfating the condensation product of ethylene oxide and $C_{8-10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3EO) sulfate, or sodium lauryl (2EO) sulfate.

Ethoxylated $C_{8-18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol. The concentration of the ethoxylated alkyl ether sulfate surfactant is about 1 to about 8 wt.%.

One example of the hydrophilizing polymer is a maleic acid-olefin copolymer produced by BASF as EP 2040 characterized by the formula

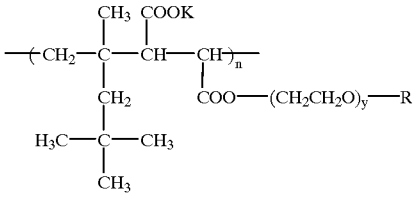

wherein R is an alkyl group having 9 to 15 carbon atoms, preferably 13 carbon atoms, y is a number from 3 to 20, preferably 5 to 12, more preferably 7 and n is a number from 15 to 150, preferably 25 to 100 and the average degree of esterification of the maleic acid conomoner by the —$(CH_2CH_2O)$y—R group is 10 mole % to 50 mole %.

The anionic surfactant and the hydrophilizing copolymer are solubilized in the water. To the composition can also be added water soluble hydrotropic salts including sodium, potassium, ammonium and mono-, di- and triethanolammonium salts. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10C. Therefore, the proportion of solubilizer generally will be from 1 % to 15%, preferably 2% to 12%, most preferably 2% to 8%, by weight of the detergent composition with the proportion of ethanol, when present, being 5% of weight or less in order to provide a composition having a flash point above 46° C. Preferably the solubilizing ingredient will be a mixture of ethanol and either sodium xylene sulfonate or sodium cumene sulfonate or a mixture of said sulfonates or ethanol and urea. Inorganic salts such as sodium sulfate, magnesium sulfate, sodium chloride and sodium citrate can be added at concentrations of 0.5 to 4.0 wt. % to control the haze of the resultant solution. Various other ingredients such as urea at a concentration of 0.5 to 4.0 wt. % or urea at the same concentration of 0.5 to 4.0 wt. % can be used as solubilizing agents. Other ingredients which have been added to the compositions at concentrations of 0.1 to 4.0 wt. % are perfumes, sodium bisulfite, ETDA and HETDA. The foregoing solubilizing ingredients also facilitate the manufacture of the inventive compositions because they tend to inhibit gel formation.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydrate; pearlescing agents and opacifiers; pH modifiers; etc. The proportion of such adjuvant materials, in total will normally not exceed 15% of weight of the detergent composition, and the percentages of most of such individual components will be a maximum of 5% by weight and preferably less than 2% by weight. Sodium formate can be included in the formula as a perservative at a concentration of 0.1 to 4.0%. Sodium bisulfite can be used as a color stabilizer at a concentration of 0.01 to 0.2 wt. %. The instant compositions are readily made by simple mixing methods from readily available components which, on storage, do not adversely affect the entire composition.

The following examples illustrate liquid cleaning compositions of the described invention. The exemplified compositions are illustrative only and do not limit the scope of the invention. Unless otherwise specified, the proportions in the examples and elsewhere in the specification are by weight.

DESCRIPTION OF THE PREFERRED EMBODIMENTS

EXAMPLE 1

The following formulas were prepared at room temperature by simply liquid mixing procedures, using the following materials:

EP 2040: Maleic acid-olefin copolymer with ethoxylated fatty alcohol amphiphilic moiety, potassium salt, ex. BASF.

HP80: Sokalan HP80 ex. BASF, polyethylene oxide polycarboxylate, sodium salt.

CP9: Sokalan CP9 ex. BASF, maleic acid-olefin copolymer, sodium salt.

| | A | B | C | D | E | F | G |
|---|---|---|---|---|---|---|---|
| EP 2040 | 1.0 | — | — | 0.025 | 0.025 | — | — |
| HP80 | — | 1.0 | — | — | — | — | — |
| CP9 | — | — | 1.0 | — | — | 0.025 | 0.025 |
| $CaCl_2.2H_2O$ | — | — | — | — | 0.044 | — | 0.044 |
| Water | Bal. | Bal. | Bal. | Bal. | Bal. | Bal. | Bal. |

Surface wettability tests were performed on Samples A to G. Black ceramic tiles are treated with Samples A to G by dipping the tiles for 1 minute into solutions. Tiles are taken out, and allowed to dry horizontally for 24 hours at room temperature. Treated tiles are put on a vertical device, and an average quantity of 3 g of water containing CaCl2.2H2O at a concentration of 0.44 g/l is sprayed on tile surface at a distance of about 20 cm, using a trigger (4 to 5 trigger strokes). A visual assessment of the water filming property is performed, using a 0 to 10 scale. 0 score is for the formation of water droplets, and corresponds to no filming effect, while 10 is for a uniform water film formation on tile surface. Intermediate scores are given to a surface not completely covered by a water film.

Glass microscope slides have been treated by Samples A to C by dipping the slides for 1 minute into solutions. Slides are allowed to drain and dry vertically at room temperature. Contact angle made by 2 microliter water droplets on glass surface treated with Samples A to C are measured. Deionized water is used as control in above described experiments.

| | A | B | C | D | E | F | G | Control |
|---|---|---|---|---|---|---|---|---|
| Water filming score (0 to 10 scale) | 9 | 0 | 8 | 8 | 9 | 7 | 10 | 0 |
| Surface tension (1% sin.) (mN/m) | 29 | 57 | 31 | 29 | 29 | 52 | 40 | 72.3 |
| Water contact angle on glass | 12 | 23 | 21 | — | — | — | — | 36 |

From the results presented in Example 1 it can be seen that the experimental copolymer used in composition A is capable of modifying the surface having been treated with this copolymer to render the surface hydrophilic. Composition A leads to a marked reduction in water contact angle measured on treated glass surface as compared to control. Composition A is also found more effective in this respect as compared to composition C. Water filming property is imparted to treated ceramic surface by compositions A, and D and E. Composition F is not as effective in imparting water filming ability than composition D. Composition B is not found effective in either tests and behaves like the control.

EXAMPLE 2

The following formulas were prepared at room temperature by simple liquid mixing procedures, using the following materials:

HP 80: Sokalan HP 80 ex. BASF, polyethylene oxide polycarboxylate, sodium salt.

SLS: Sodium Lauryl Sulfate.

AEOS.2EO: Alcohol Ethoxy Sulfate, bearing two ethoxy groups on average.

| | H | I | J | K | L | M | N | O | Control |
|---|---|---|---|---|---|---|---|---|---|
| HP 80 | 0.05 | 0.05 | — | 0.05 | 0.05 | 0.05 | 0.05 | 0.05 | — |
| SLS | — | — | 0.07 | 0.07 | 0.07 | — | — | — | — |
| AEOS.2EO | — | — | — | — | — | 0.09 | 0.09 | 0.09 | — |
| $CaCl_2.2H_2O$ | — | 0.007 | — | — | 0.007 | — | 0.007 | 0.044 | — |
| Water | Bal. | Bal. | Bal. | Bal. | Bal. | Bal. | Bal. | Bal. | — |
| Water filming score (0 to 10 scale) | 0 | 2 | 5 | 8 | 6 | 8 | 9 | 10 | 0 |

Surface wettability tests were performed on Samples H to O following the procedure described in Example 1. Deionized water is used as control in Example 1.

From compositions K and M presented in Example 2 it can be seen that combining polyethylene oxide polycarboxylate copolymer Sokalan HP 80 and an anionic surfactant like sodium lauryl sulfate or alcohol ethoxy sulfate bearing two ethoxy groups, enable modifying the surface having been treated with said mixtures to render the surface hydrophilic. Composition N shows that surface wettability is improved in the presence of alkaline earth counterions like calcium ions, providing alcohol ethoxy sulfate is the incorporated anionic surfactant. Complete coverage of ceramic tile surface by a water film is observed on tile having been treated with composition 0, when spraying on tile surface water containing $CaCl_2.2H_2O$ at a concentration of 0.44 g/l, as described in above test procedure.

What is claimed:

1. A cleaning composition comprising approximately by weight:

(a) 0.1% to 10% of an anionic surfactant;

(b) 0.01% to 2% of a hydrophilizing polymer which is a maleic acid-olefin copolymer, wherein the polymer can be partially esterified by polyethylene glycol, or partially esterified by an amphiphilic moiety, or an acrylic acid polymer partially esterified by polyethylene glycol, or partially esterified by an amphiphilic moiety, and (c) the balance being water, wherein said hydrophilizing copolymer is characterized by the formula:

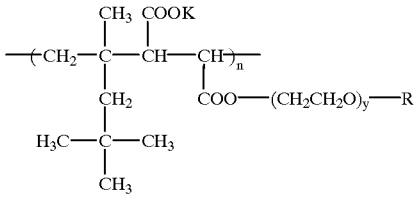

wherein n is a number from 15 to 150, y is a number from 3 to 20 and R is an alkyl group having 9 to 15 car atoms and wherein the composition does not contain nonionic surfactants containing ethoxylate groups, silicon containing polymers, amino containing polymers, copolymers of N-vinylimidazole N-vinylpyrrolidone (PVPVI), or quaternized vinyl pyrrolidone/dialkylaminoalkyl acrylate or methacrylate copolymers, or polyvinyl pyridine N-oxide polymers.

* * * * *